US011555317B2

(12) United States Patent
Boyd et al.

(10) Patent No.: US 11,555,317 B2
(45) Date of Patent: Jan. 17, 2023

(54) MOMENT CONNECTION COMPONENT CLAMPING TOOL

(71) Applicant: ConXtech, Inc., Pleasanton, CA (US)

(72) Inventors: John S. Boyd, Tiburon, CA (US); Kevin Marek, Hayward, CA (US); Eric Bellman, Hayward, CA (US); Maxwell C. Simmons, Hayward, CA (US); Robert J. Simmons, Hayward, CA (US); Kyle Joseph Palmiscno, Loveland, CO (US)

(73) Assignee: ConXtech, Inc., Pleasanton, CA (US)

( * ) Notice: Subject to any disclaimer, the term of this patent is extended or adjusted under 35 U.S.C. 154(b) by 841 days.

(21) Appl. No.: 16/271,748

(22) Filed: Feb. 8, 2019

(65) Prior Publication Data

US 2019/0249449 A1 Aug. 15, 2019

Related U.S. Application Data

(60) Provisional application No. 62/628,853, filed on Feb. 9, 2018, provisional application No. 62/628,807, filed on Feb. 9, 2018.

(51) Int. Cl.
*E04G 21/16* (2006.01)
*B25B 5/14* (2006.01)
(Continued)

(52) U.S. Cl.
CPC ..... *E04G 21/16* (2013.01); *B25B 5/109* (2013.01); *B25B 5/14* (2013.01); *E04B 1/2403* (2013.01);
(Continued)

(58) Field of Classification Search
CPC . E04G 21/16; E04G 5/045; E04B 2001/2424; E04B 2001/2457;
(Continued)

(56) References Cited

U.S. PATENT DOCUMENTS 835,059 A 11/1906 Curley
925,677 A 6/1909 Belcher
(Continued)

FOREIGN PATENT DOCUMENTS

DE 2758992 A1 7/1979
DE 102009050139 A1 4/2011
(Continued)

OTHER PUBLICATIONS

The International Bureau of WIPO, International Preliminary Report on Patentability regarding PCT Application No. PCT/US2019/017374, dated Aug. 11, 2020, 7 pages.
(Continued)

*Primary Examiner* — Tyrone V Hall, Jr.
*Assistant Examiner* — Makena S Markman
(74) *Attorney, Agent, or Firm* — Kolisch Hartwell, P.C.

(57) ABSTRACT

A collar flange assembly clamping tool is disclosed, including an axle having a long axis, and a pair of arms mounted on the axle. At least one of the arms is slideable along the long axis. Each arm includes a primary axis perpendicular to the long axis of the axle, a proximal end portion, and a distal end portion with a tab. The proximal end portion includes a clamping device that moves in a direction perpendicular to the primary axis of the arm and the long axis of the axle.

17 Claims, 3 Drawing Sheets

(51) Int. Cl.
*E04B 1/24* (2006.01)
*B25B 5/10* (2006.01)

(52) U.S. Cl.
CPC ..... *E04B 2001/2424* (2013.01); *E04B 2001/2457* (2013.01)

(58) Field of Classification Search
CPC ... E04B 2001/2403; B25B 5/109; B25B 5/14; B25B 5/02; B25B 5/085; B25B 1/00; B25B 1/02; B25B 1/22; B25B 1/2431; F16B 2/065; F16B 2/12; F16B 5/0275; F16B 5/0291; F16B 7/0406; F16B 7/187; F16B 7/182; F16B 7/22; F16B 2200/205; F16B 2200/40; F16B 2200/406; F16B 2200/403; F16B 2200/50; F16B 2200/509; F16B 2200/503; F16B 2200/506
See application file for complete search history.

(56) References Cited

U.S. PATENT DOCUMENTS 1,110,185 A 9/1914 Brown et al.
1,367,044 A 2/1921 Hausler
1,400,066 A 12/1921 Huck
1,471,094 A 10/1923 Bloss
1,729,743 A 10/1929 Jorgensen et al.
2,008,087 A 7/1935 Stromberg
2,421,257 A 5/1947 Genter
2,569,653 A 10/1951 Boedecker
2,673,700 A 3/1954 Eberhardt
2,942,557 A 6/1960 Hirsch et al.
3,071,205 A 1/1963 Beck, Jr.
3,148,477 A 9/1964 Bjørn et al.
3,270,997 A 9/1966 Gethmann
3,389,929 A * 6/1968 Williams ..... E04B 1/3441 403/73
3,396,499 A 8/1968 Biffani
3,401,739 A 9/1968 Opletal
3,410,044 A 11/1968 Moog
3,499,676 A 3/1970 Haeussler
3,533,592 A 10/1970 Jennings
3,562,988 A 2/1971 Gregoire
3,664,011 A 5/1972 Labastrou
3,685,866 A 8/1972 Patenaude
3,706,169 A 12/1972 Rensch
3,784,151 A 1/1974 Steele
3,829,999 A 8/1974 Bernstein
3,977,801 A 8/1976 Murphy
4,014,151 A 3/1977 Erhart
4,019,298 A 4/1977 Johnson, IV
4,058,339 A 11/1977 Burchard, Jr.
4,059,931 A 11/1977 Mongan
4,079,983 A 3/1978 Van Mastrigt
4,173,367 A 11/1979 Haeussler
4,306,397 A 12/1981 Ramseyer
4,360,230 A 11/1982 Wood et al.
4,371,203 A * 2/1983 Munro ..... B66C 1/64 294/103.1
4,398,762 A 8/1983 Haeussler et al.
4,438,607 A 3/1984 Nelson
4,522,001 A 6/1985 Meyer
4,540,210 A 9/1985 Smith
4,577,449 A 3/1986 Celli
4,671,554 A 6/1987 Lancelot
4,671,724 A 6/1987 Bolton
4,684,285 A 8/1987 Cable
4,701,131 A 10/1987 Hildebrandt et al.
4,736,554 A 4/1988 Tyler
4,742,665 A 5/1988 Baierl
4,754,712 A 7/1988 Olson et al.
4,769,960 A 9/1988 Zipf et al.
4,821,844 A 4/1989 Huffman et al.
4,830,144 A 5/1989 Werner
4,852,501 A 8/1989 Olson et al.
4,905,436 A 3/1990 Matsuo et al.
5,061,111 A 10/1991 Hosokawa
5,240,089 A 8/1993 Spera
5,244,300 A 9/1993 Perreira et al.
5,289,665 A 3/1994 Higgins
5,342,138 A 8/1994 Saito et al.
5,590,974 A 1/1997 Yang
5,605,410 A 2/1997 Pantev
5,615,529 A 4/1997 Johnson et al.
5,617,931 A 4/1997 Zygmun et al.
5,678,375 A 10/1997 Juola
5,863,020 A * 1/1999 Olson ..... E04G 21/3242 248/228.3
5,865,122 A 2/1999 Hudson et al.
6,082,070 A 7/2000 Jen
6,092,347 A 7/2000 Hou
6,106,186 A 8/2000 Taipale et al.
6,219,989 B1 4/2001 Tumura
6,378,265 B1 4/2002 Konstandt
6,390,719 B1 5/2002 Chan
6,554,102 B2 4/2003 Schwörer
6,651,393 B2 11/2003 Don et al.
6,802,169 B2 10/2004 Simmons
6,837,016 B2 1/2005 Simmons et al.
6,913,422 B2 7/2005 Rogers
7,021,020 B2 4/2006 Simmons et al.
7,032,712 B2 4/2006 Schwörer
7,082,694 B2 8/2006 Lyman, Jr.
7,134,701 B1 11/2006 Ronning
7,455,338 B2 * 11/2008 Jenney ..... B66C 1/30 294/81.3
7,469,485 B1 12/2008 Perdue
7,470,081 B2 12/2008 Miyahara et al.
7,484,715 B2 * 2/2009 Hoffend, Jr. ..... A63J 1/02 212/98
7,562,919 B2 7/2009 Lawley
7,621,099 B2 11/2009 Simmons
D611,166 S 3/2010 Hammer
7,677,522 B2 3/2010 Bakos
7,941,985 B2 5/2011 Simmons
8,011,150 B2 9/2011 Luttrell et al.
8,056,299 B2 11/2011 Liskey
8,132,774 B1 3/2012 Whatcott
8,136,460 B2 3/2012 Tait et al.
8,161,698 B2 4/2012 Migliore
8,161,707 B2 4/2012 Simmons
8,297,002 B2 10/2012 Fernández
8,297,887 B2 10/2012 Ness et al.
8,480,041 B2 * 7/2013 Myers ..... F16L 3/1211 248/72
8,522,507 B2 9/2013 Asada et al.
8,528,298 B2 9/2013 Semaan et al.
8,627,615 B2 1/2014 Moyher
8,646,232 B2 2/2014 Liskey
9,493,326 B2 11/2016 Simmons et al.
9,611,664 B2 * 4/2017 Tsaousis ..... E04G 21/3242
9,677,585 B2 * 6/2017 Broussard ..... F16B 7/0493
10,415,616 B2 * 9/2019 Nehls ..... F16B 2/12
2002/0043038 A1 4/2002 Cerrato
2002/0083607 A1 * 7/2002 Atsuhiko ..... G01B 21/30 33/553
2003/0178253 A1 9/2003 Tatge et al.
2004/0195479 A1 * 10/2004 Gulley ..... F16B 2/12 248/228.1
2004/0237439 A1 12/2004 Powell
2005/0066612 A1 3/2005 Simmons
2007/0163834 A1 * 7/2007 Casebolt ..... A62B 35/0068 182/3
2007/0256391 A1 11/2007 Mifsud et al.
2008/0245023 A1 10/2008 Simmons
2008/0295443 A1 12/2008 Simmons
2009/0052980 A1 2/2009 Williams
2010/0316441 A1 12/2010 Vicentelli
2011/0031371 A1 2/2011 Rube
2012/0110947 A1 5/2012 Simmons
2012/0160137 A1 6/2012 Linares
2012/0292131 A1 11/2012 Lovas
2013/0319796 A1 12/2013 Davis

(56) References Cited

U.S. PATENT DOCUMENTS

| | | | |
|---|---|---|---|
| 2014/0183330 | A1 | 7/2014 | Simmons et al. |
| 2014/0202795 | A1 | 7/2014 | Simmons et al. |
| 2014/0208666 | A1 | 7/2014 | Simmons et al. |
| 2015/0091315 | A1 | 4/2015 | Butterfield, IV |
| 2015/0284968 | A1 | 10/2015 | Simmons et al. |

FOREIGN PATENT DOCUMENTS

| | | | |
|---|---|---|---|
| FR | 2054723 | A | 7/1971 |
| FR | 2471461 | A1 | 6/1981 |
| FR | 2613403 | A1 | 10/1988 |
| GB | 1204327 | A | 9/1970 |
| GB | 2261651 | A | 5/1993 |
| JP | 11-22001 | A | 1/1999 |
| JP | 2000-110236 | A | 4/2000 |
| WO | 98036134 | A1 | 8/1998 |
| WO | 2011047830 | A1 | 4/2011 |
| WO | 2015106291 | A1 | 7/2015 |

OTHER PUBLICATIONS

CONXTECH. 'ConX Modular Pipe Rack' [online]. Jan. 6, 2013. Retrieved from the internet: <http://www.conxtech.com/conx-system/conx-modular-pipe-rack/>; p. 1, figure 1, paragraphs 1, 2; p. 2, paragraph 1, 3 pages.

CONXTECH Brochure. 'CONX Modular Pipe Rack' [online]. Apr. 16, 2014. Retrieved from the internet: <http://www.conxtech.com_wp-content_uploads_files_documents_ConX_Modular_Pipe_Rack_Brochure.pdf>; 25 pages.

The U.S. Receiving Office of WIPO, International Search Report and Written Opinion of the International Searching Authority regarding PCT Application No. PCT/US2014/013014, dated May 19, 2014, 6 pages.

U.S. Patent and Trademark Office, Office action regarding U.S. Appl. No. 14/163,778, dated Oct. 1, 2014, 16 pages.

U.S. Patent and Trademark Office, Office action regarding U.S. Appl. No. 14/163,778, dated Jan. 26, 2015, 16 pages.

The U.S. Receiving Office of WIPO, International Search Report and Written Opinion of the International Searching Authority regarding PCT Application No. PCT/2015/011270, dated Apr. 6, 2015, 6 pages.

U.S. Patent and Trademark Office, Office action regarding U.S. Appl. No. 14/596,135, dated Feb. 23, 2016, 30 pages.

The International Bureau of WIPO, International Preliminary Report on Patentability regarding PCT Application No. PCT/US2015/011270, dated Jul. 19, 2016, 5 pages.

The European Patent Office, Extended European Search Report regarding European Patent Application No. 15735326.9, dated Jun. 21, 2017, 8 pages.

The European Patent Office, Examination Report regarding European Patent Application No. 15735326.9, dated Mar. 19, 2020, 5 pages.

U.S. Receiving Office of WIPO, International Search Report regarding PCT Patent Application No. PCT/US19/17374, dated Apr. 23, 2019, 5 pages.

U.S. Receiving Office of WIPO, Written Opinion of the International Searching Authority regarding PCT Patent Application No. PCT/US19/17374, dated Apr. 23, 2019, 6 pages.

* cited by examiner

MOMENT CONNECTION COMPONENT CLAMPING TOOL

CROSS-REFERENCES

This application claims the benefit under 35 U.S.C. § 119(e) of the priority of U.S. Provisional Patent Application Ser. No. 62/628,853, filed Feb. 9, 2018, and of U.S. Provisional Patent Application Ser. No. 62/628,807, filed Feb. 9, 2018, the entireties of which are hereby incorporated by reference for all purposes. U.S. Pat. No. 7,941,985 B2 is also incorporated by reference herein, in its entirety, for all purposes.

INTRODUCTION

Steel frame building construction requires connection of beams and columns, and moment resisting connections are needed for continuous frames. Collar beam mounts offer a valuable improvement over on-site welding techniques. Welding can be done off site in controlled conditions, and frame members are seated in the proper spatial orientation when connected by a collar beam mount.

U.S. Pat. No. 7,941,985 B2 discloses an exemplary full moment collar beam mount, described as a halo/spider connection. Where a beam and a column connect, a collar flange assembly is welded to the end of the beam. Two collar corners are welded to corners on either side of a face of the column. To connect, the beam is lowered so that the flange assembly is received between the collar corners, which form a tapered channel. Connections on all faces of the column together form a full moment collar.

The beam connections allow precise building frame construction, but also require precise manufacturing. Along the length of a building frame, many beam and column connections line up and tolerances from multiple components may additively, adversely affect another connection. This can result in undesirable overall deviation from specifications. Manufacturing tools and methods are needed to facilitate precise positioning and welding of beam connection components in the manufacturing process.

SUMMARY

The present disclosure provides systems, apparatuses, and methods relating to full moment collar component clamping tools. In some examples, a component clamping tool may include an axle having a long axis, and a pair of arms mounted on the axle. At least one of the arms may be slideable along the long axis. Each arm may include a primary axis perpendicular to the long axis of the axle, a proximal end portion, and a distal end portion with a tab. The proximal end portion may include a clamping device that moves in a direction perpendicular to the primary axis of the arm and the long axis of the axle. In some examples, the arms may be configured to cooperatively secure a full moment collar flange assembly to the end of an I-beam.

In another example, a clamp device is configured to grip a flange of an I-beam on opposite sides of the web of the I-beam, and a pair of hook members rigidly extend from the clamp device and are configured to secure a flange member of a flange assembly to an end portion of the I-beam.

In some examples, a method of securing a collar flange assembly to an I-beam may include positioning the flange assembly at the end of the beam and separating a pair of arms of a clamping tool along an axle. The method may further include positioning the arms on opposing side of a web of the beam, and contacting the arms with the opposing sides of the web. The method may further include tightening a clamping device of each arm against a flange of the I-beam.

Features, functions, and advantages may be achieved independently in various examples of the present disclosure, or may be combined in yet other examples, further details of which can be seen with reference to the following description and drawings.

DETAILED DESCRIPTION

Figure 2:
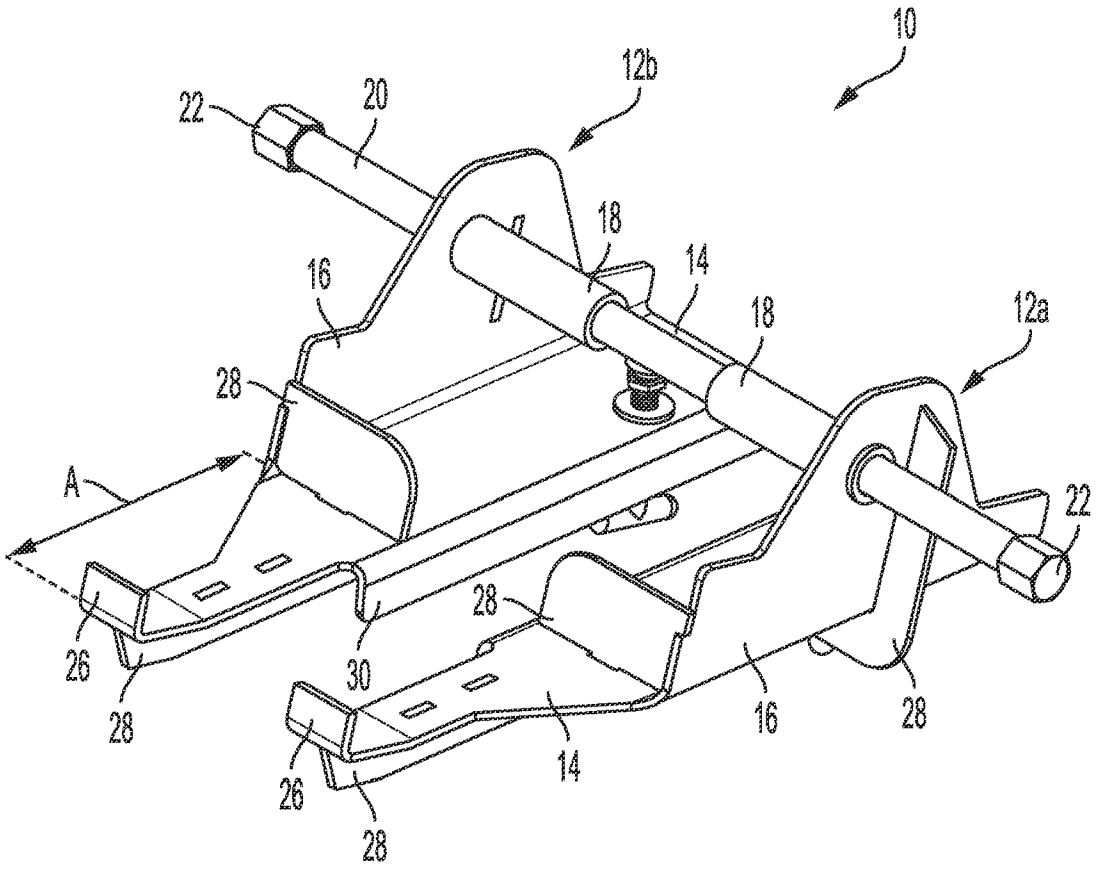
FIG. 2 is an isometric front view of an illustrative flange clamp in accordance with aspects of the present disclosure.

Various aspects and examples of a component clamping tool having an axle and two arms as well as related methods of use, are described below and illustrated in the associated drawings. Unless otherwise specified, a component clamping tool in accordance with the present teachings, and/or its various components may, but are not required to, contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed examples. The following description of various examples is merely illustrative in nature and is in no way intended to limit the disclosure, its application, or uses. Additionally, the advantages provided by the examples described below are illustrative in nature and not all examples provide the same advantages or the same degree of advantages.

This Detailed Description includes the following sections, which follow immediately below: (1) Overview; (2) Examples, Components, and Alternatives; (3) Illustrative Combinations and Additional Examples; (4) Advantages, Features, and Benefits; and (5) Conclusion. The Examples, Components, and Alternatives section is further divided into subsections A and B, each of which is labeled accordingly.

Overview

In general, a component clamping tool may also be referred to as a flange clamp, and may include two arms mounted on a central axle. Each arm may have a proximal end portion with a clamping device, and distal end portion with an upwardly extending tab. The arms may have dimensions and geometry appropriate to conform to an I-beam and a collar flange assembly of a full moment collar beam mount. The clamp may be configured to secure the assembly to the beam.

The central axle may have a long axis, each of the arms having a parallel long axis. The two arms may be mounted on the central axle such that the arms are movable relative to one another along the long axis of the axle. The central axle may slidably extend through an aperture in at least one of the arms, and/or the central axle may be adjustable in length. For example, the central axle may include telescopic elements. The arms may be movable between a first separating distance at least greater than a width of the flange of an I-beam and a second separating distance approximately equal to a width of the web of the I-beam. One or both of the arms may also be pivotable about the central axle.

Each arm may include a platform surface extending from the proximal end portion to the distal end portion. The platform surface may define a width of the arm, which may taper toward the distal end portion of the arm. An inner surface may extend orthogonally from the platform surface. In some examples, the inner surface may also be orthogonal to the long axis of the central axle. The inner surface may be configured to contact the web of the I-beam when the clamp is secured to the beam. In some examples, each arm may be at least partially assembled from sheet metal and/or pieces of one or more metal sheets.

The clamping device of the proximal end portion may include an extendable member configured to contact an underside of the flange of the beam. When the clamp is positioned on the beam, the extendable member may be fixed in frictional contact with the flange, thereby securing the flange clamp relative to the beam. For example, a threaded member may be screwed through the arm to bring a nut in contact with the flange of the I-beam.

The arms of the clamp may be of sufficient length to extend past a front surface of a flange of a collar flange assembly when the assembly is positioned at the end of the I-beam and the clamp is positioned on the beam. The tabs of the distal end portions of the arms may be positioned to contact the front surface, or column-facing side, of the collar flange assembly. When the flange clamp is secured to the beam, the collar flange assembly may be held against the beam by the tabs.

Examples, Components, and Alternatives

The following sections describe selected aspects of exemplary component clamping tools as well as related systems and/or methods. The examples in these sections are intended for illustration and should not be interpreted as limiting the entire scope of the present disclosure. Each section may include one or more distinct examples, and/or contextual or related information, function, and/or structure.

A. Illustrative Clamp

Figure 1:
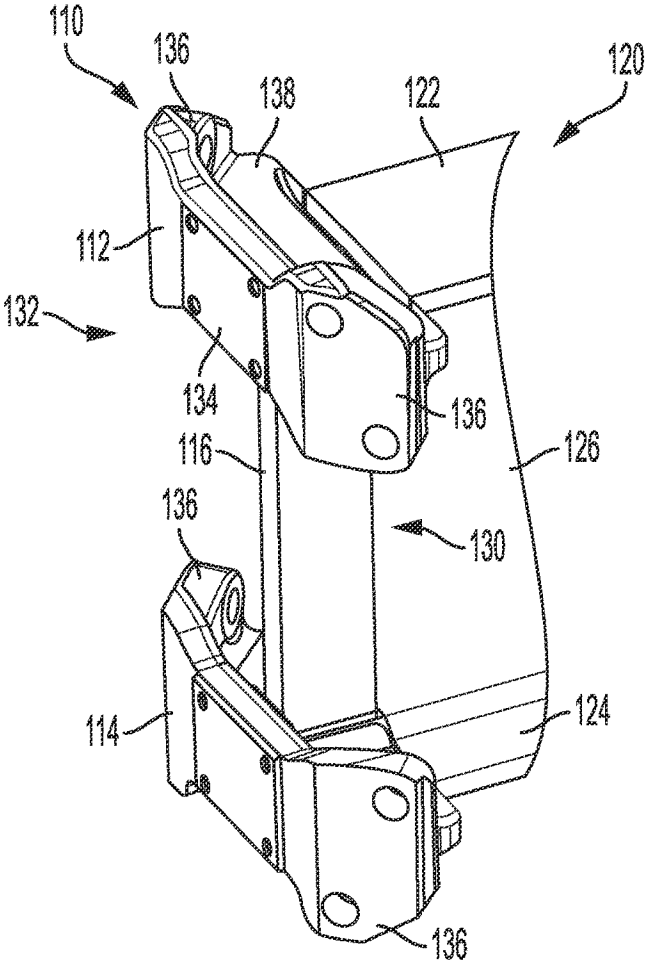
FIG. 1 is an isometric view of an illustrative collar flange assembly fixed to an end of an I-beam.

As shown in FIGS. 2-5, this section describes an illustrative flange clamp 10. Clamp 10 is an example of a component clamping tool, described above. FIG. 1 is an isometric view of an illustrative collar flange assembly 110 positioned at an end of an I-beam 120. Flange assembly 110 includes an upper flange member 112, a lower flange member 114, and a bridging component 116. When positioned at the end of beam 120, upper flange member 112 is aligned with an upper flange 122 of the beam, lower flange member 114 is aligned with a lower flange 124 of the beam, and bridging component 116 is aligned with a web 126 of the beam.

Collar flange assembly 110 and each component of the assembly have a beam facing side 130 and a column facing side 132. Each flange member has a main body with a central span 134 and angled wing portions 136 extending from each end. A crosspiece 138 extends from beam facing side 130 of the main body and wing portions. Clamp 10 is configured to engage web 126 and one flange 122 of beam 120, and secure one of flange members 112, 114.

As shown in FIG. 2, clamp 10 includes a central axle 20, and two arms 12*a* and 12*b*. The arms are matching but mirrored and descriptions of first arm 12*a* below may be considered a sufficient description of second arm 12*b* also.

Arm 12*a* includes a horizontal portion 14 and a roughly perpendicular side wall portion 16 extending up from the horizontal portion. In some examples, the portions may both be part of a folded sheet of metal. A sleeve 18 is coupled to side wall portion 16, generally parallel horizontal portion 14. Central axle 20 is slidably received in sleeve 18, and has an end cap 22 at each of a first and a second end to prevent the axle from sliding out of the sleeve. Central axle 20 may also be rotatable within sleeve 18.

Arms 12*a* and 12*b* may be slid apart from one another on central axle 20 until end caps 22 prevent further sliding. The arms may alternately be slid toward one another on central axle 20 until a closest portion of the arms comes into contact, such as a distal end of sleeve 18. Central axle 20 may be of sufficient length to permit the arms to be separated sufficiently to fit over a variety of beam flange sizes. The sliding adjustment of the arms may also allow clamp 10 to be used with a variety of beams and/or accommodate production variations in beam size.

At a front end of the arm, horizonal portion 14 of arm 12*a* narrows and is angled up in a slope 24. At a distal end of the slope is a vertical, upwards-extending tab 26. In some examples, the slope and tab may be a folded part of the same sheet of metal as the horizontal portion. Side wall portion 16 of arm 12*a* extends part way along an outer edge of horizonal portion 14, from a back end of the arm to a point proximate where horizontal portion 14 begins to narrow. On an inner side of horizonal portion 14, opposite side wall portion 16, a lip or contact surface 30 extends down from horizontal portion 14. The contact surface may be generally parallel to side wall portion 16 and extend along roughly the same length of horizontal portion 14 as the side wall portion. In some examples, the contact surface may be a folded part of the same sheet of metal as the horizontal portion.

Multiple braces 28 structurally reinforce arm 12, including at the end point of side wall portion 16. In some examples, the braces may be slotted into the horizontal and side wall portions and may be welded in place. In some examples, the braces may be cast as part of a unitary arm 12*a*, and in some examples arm 12*a* may not include braces.

Figure 3:
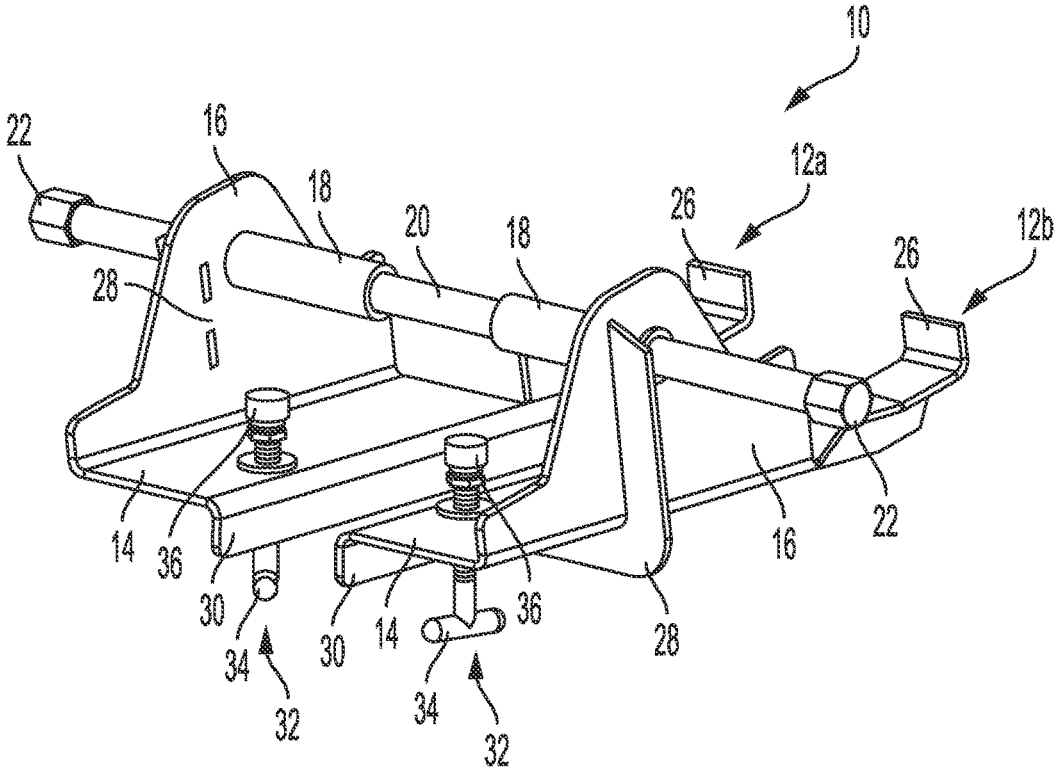
FIG. 3 is an isometric rear view of the flange clamp of FIG. 2.

FIG. 3 shows more clearly a clamp actuator 32. The actuator includes a threaded T-bolt 34 with a cap nut 36 having a flat upper surface. The T-bolt extends through a threaded aperture in horizontal portion 14, proximate the back end of arm 12*a*. The head of T-bolt 34 is disposed below horizontal portion 14 and cap nut 36 above, such that turning the T-bolt alternatively raises or lowers the cap nut.

Dimensions of clamp 10 and arms 12*a*, 12*b* may correspond to dimensions of a beam with a coupled or appropriately positioned collar flange assembly. For example, dimension A shown in FIG. 2 is measured from a rear face of tab 26, in a direction perpendicular to central axle 20 to a point laterally in line with a forward-most edge of side wall portion 16. Dimension A may correspond to or may be greater than a width of an upper flange of a collar flange assembly, as measured from rear edge of a crosspiece of the upper flange to a corresponding point on a front face of the upper flange.

Figure 4:
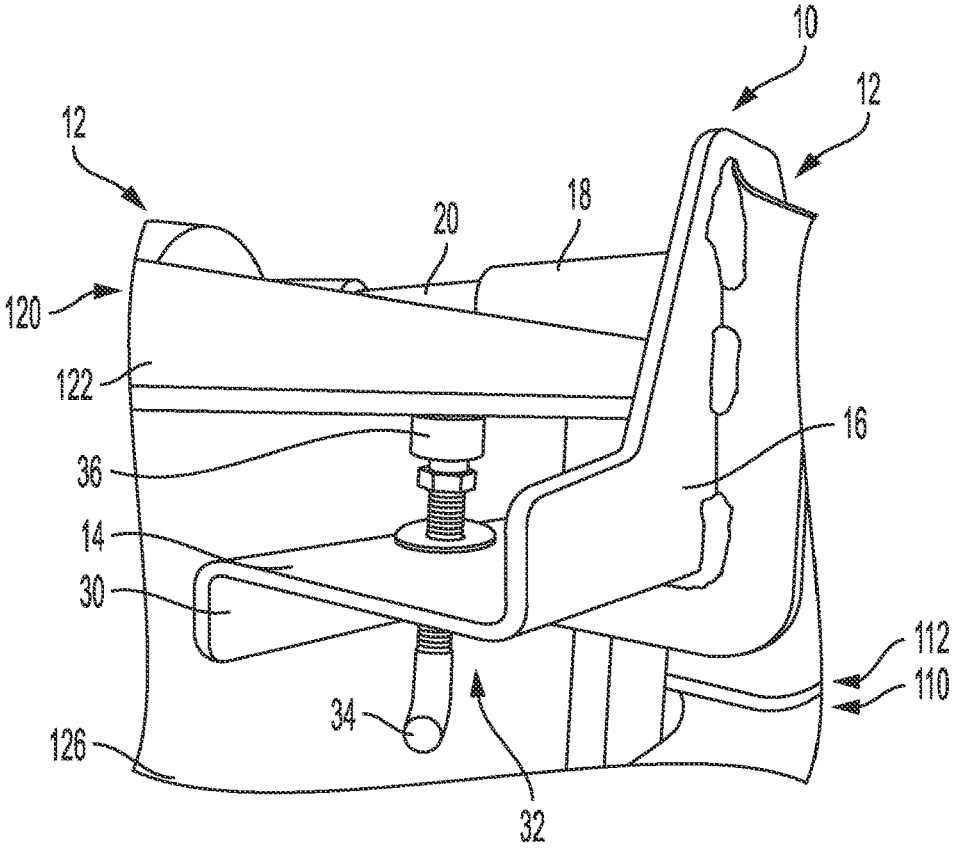
FIG. 4 is an isometric rear view of the flange clamp of FIG. 2, securing a collar flange assembly to an end of an I-beam.

In FIG. 4, clamp 10 is shown engaging upper flange member 112 of collar flange assembly 110, adjacent I-beam 120. Side wall portions 16 are disposed at either side of upper flange 122 of the beam such that sleeves 18 and received central axle 20 extend over the upper flange. Horizontal portions 14 extend from the side wall portions in toward web 126 of the beam.

Clamp actuator 32 is shown untightened, with T-bolt 34 and cap nut 36 spaced from upper flange 122. When the clamp is engaged, lip 30 contacts web 126 and cap nut 36 contacts an underside of upper flange 122. Frictional forces between cap nut 36 and upper flange 122, and between lip 30 and web 126 may secure the clamp to the beam.

Figure 5:
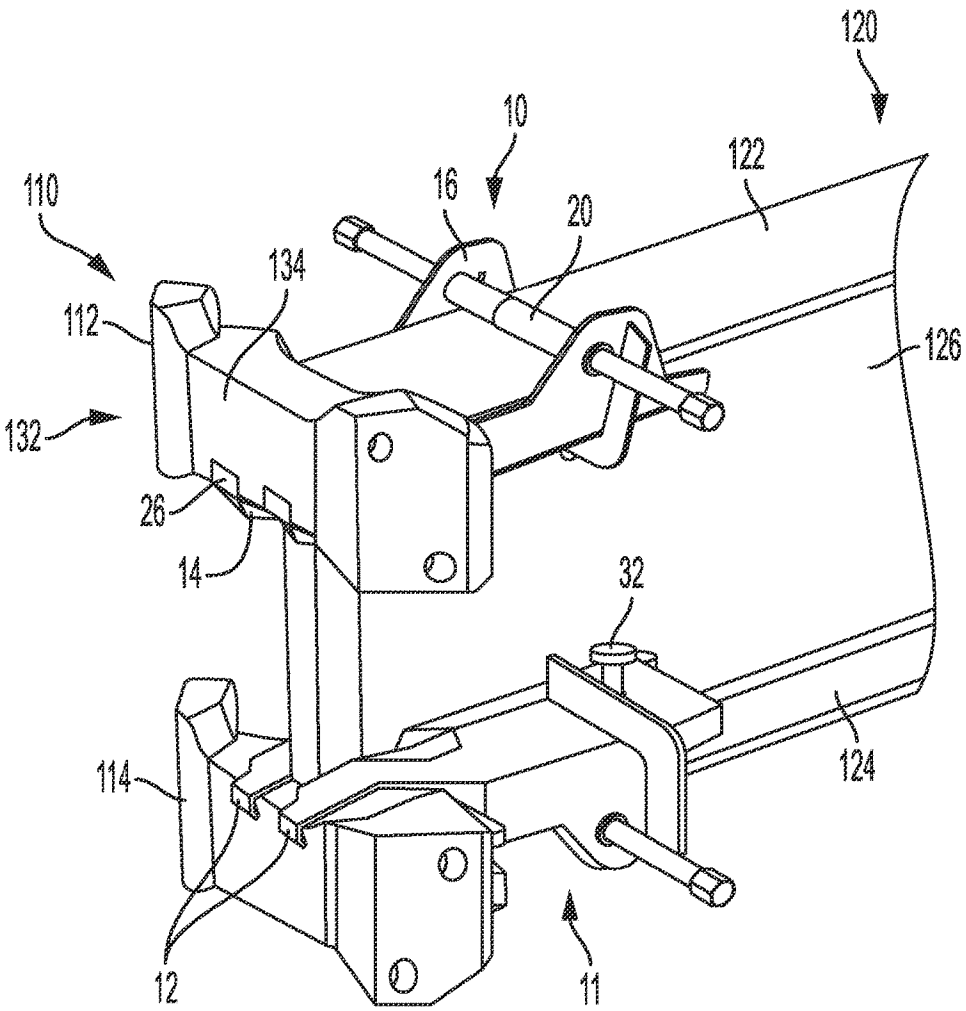
FIG. 5 is an isometric front view of the flange clamp of FIG. 2 and another illustrative flange clamp, securing a collar flange assembly to an end of an I-beam.

In FIG. 5, column facing side 132 of collar flange assembly 110 is shown. Horizontal portions 14 of arms 12 extend out, under upper flange member 112 of collar flange assembly 110. Each horizontal portion 14 extends on one side of bridging component 116 such that tab 26 at the distal end of each arm contacts the column facing side of central span 134 of upper flange 112. Tabs 26 may hold upper flange 112 against beam 120, and arms 12 may support the flange member.

Also shown in FIG. 5 is a second clamping tool 11, securing lower flange 114 of collar flange assembly 110 to I-beam 120. Second clamping tool 11 is disposed in a reversed or upside-down orientation to engage a correct side of lower flange 114 of the flange assembly and lower flange 124 of the beam. Together clamping tools 10 and 11 secure the collar flange assembly to the beam.

B. Illustrative Method

Figure 6:
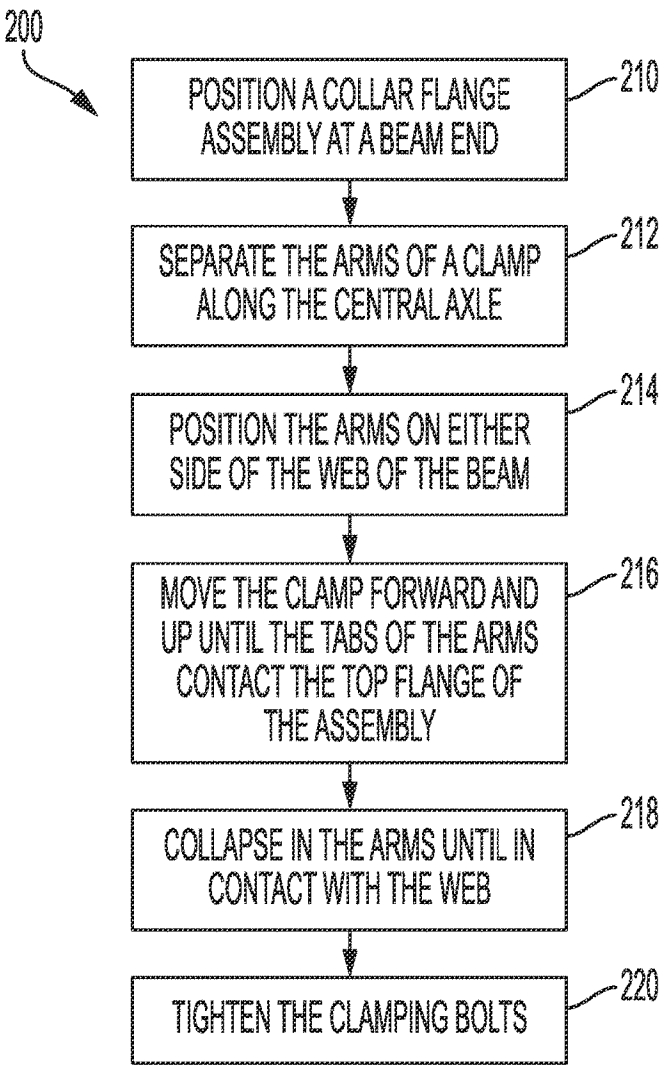
FIG. 6 is a flow chart depicting steps of an illustrative method for clamping a collar flange assembly to an I-beam, according to the present teachings.

This section describes steps of an illustrative method for clamping a collar flange assembly to an I-beam; see FIG. 6. Aspects of flange clamps or component clamping tools described above may be utilized in the method steps described below. Where appropriate, reference may be made to components and systems that may be used in carrying out each step. These references are for illustration, and are not intended to limit the possible ways of carrying out any particular step of the method.

FIG. 6 is a flowchart illustrating steps performed in an illustrative method, and may not recite the complete process or all steps of the method. Although various steps of method 200 are described below and depicted in FIG. 6, the steps need not necessarily all be performed, and in some cases may be performed simultaneously or in a different order than the order shown.

To clamp a collar flange assembly to an I-beam, the assembly may first be lifted into a correct position by a picker or hook. Step 210 includes positioning the collar flange assembly at the end of the beam. Once positioned, one or more clamps may be placed on the beam.

Step 212 includes separating the arms of the clamp along a central axle. To accomplish this, two arms of the clamp may be slid along a central axle and/or the axle may be extended, for instance the axle may be telescoped. Step 214 includes positioning the arms on either side of the web of the beam. The arms may be lowered on either side of a top flange of the I-beam, and the two arms may be slid together again, toward a web of the beam.

At step 216 the method includes moving the clamp forward and up until the tabs of the arms contact the top flange of the assembly. This step may include translating and/or rotating of the clamp to achieve a desired position. The clamp may be brought along the beam to the end where the collar flange assembly is positioned. The arms may be rotated on the central axis, to lower tabs on the distal end of the arms below the upper flange of the collar flange assembly. The tabs may be passed on either side of the bridging component of the collar flange assembly and the arms rotated back up. The clamp may then be moved back from the end of the beam until the tabs engage a front, or column-facing, side of the upper flange of the collar flange assembly.

Step 218 includes collapsing the arms until in contact with the web of the beam.

The arms may be slid along the central axle until an inner lip on the arm contacts the web. The clamp may be thereby adjusted to accommodate a variety of beam sizes and/or production variations in the beam size.

At step 220, the method includes tightening the clamping bolts of the clamp. A bolt threaded through each arm may be tightened to bring a flat upper surface of an attached cap nut into contact with an underside of the top flange of the beam. The bolts may be tightened until frictional contact between the nuts and the flange of the beam, and the lips and the web of the beam are sufficient to secure the clamp in place. As loads are applied to the clamp by lifting and/or transport of the beam and collar flange assembly, the clamp may tend to tightening and further secure the flange assembly.

In some examples, method 200 may be repeated with a second clamp, for the lower flange member of the collar flange assembly. Method 200 may also be repeated to secure a collar flange assembly to a second end of the beam.

Illustrative Combinations and Additional Examples

This section describes additional aspects and features of component gripping apparatus, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A. A clamping tool, comprising:

An axle having a long axis,

A pair of arms mounted on the axle, at least one of the arms being slideable along the long axis, each arm having a long axis, a proximal end portion, and distal end portion, the proximal end portion being equipped with a clamping device that moves in a direction perpendicular to the long axis of the arm, the distal end portion having an upwardly extending tab configured to contact a column-facing side of a collar flange assembly.

A1. The clamping tool of A, wherein the arms are configured to cooperatively secure a collar flange assembly on the end of a beam.

A2. The clamping tool of A or A1, wherein each arm has a platform surface extending from the proximal end portion to the distal end portion, and an inner surface extending orthogonally from the platform surface, the inner surface being configured to contact a web of an I-beam.

A3. The clamping tool of any of A-A2, wherein the clamping device includes a threaded shaft.

A4. The clamping tool of any of A-A3, wherein each arm is slideable and pivotable relative to the axle.

A5. The clamping tool of any of A-A4, wherein the axle has an adjustable length.

A6. The clamping tool of any of A-A5, wherein the axle includes a telescoping mechanism.

A7. The clamping tool of any of A-A6, wherein each arm includes an assembly of metal sheet pieces.

A8. The clamping tool of any of A-A7, wherein each arm has a width that tapers to a smaller dimension toward the distal end portion.

B. A clamping tool, comprising:

an axle having a long axis; and a pair of arms mounted on the axle, at least one of the arms being slideable along the long axis, each arm including:

a primary axis perpendicular to the long axis of the axle, a proximal end portion including a clamping device that moves in a direction perpendicular to the primary axis of the arm and the long axis of the axle, and a distal end portion including a tab.

B1. The clamping tool of B, wherein each arm has a platform surface extending from the proximal end portion to the distal end portion, and an inner surface extending orthogonally from the platform surface.

B2. The clamping tool of B or B1, wherein each clamping device includes a threaded shaft extending through a threaded aperture of the corresponding arm.

B3. The clamping tool of any of B-B2, wherein each threaded shaft includes a cap nut at a first end.

B4. The clamping tool of any of B-B3, wherein each arm is slideable and pivotable relative to the axle.

B5. The clamping tool of any of B-B4, wherein the axle has an adjustable length.

B6. The clamping tool of any of B-B5, wherein the axle includes a telescoping mechanism.

B7. The clamping tool of any of B-B6, wherein each arm includes an assembly of metal sheet pieces.

B8. The clamping tool of any of B-B7, wherein each arm has a width that tapers to a smaller dimension toward the distal end portion.

C. A clamping tool, comprising:

an axle having a long axis; and a pair of arms mounted on the axle, at least one of the arms being slideable along the long axis, each arm including:

a primary axis perpendicular to the long axis of the axle, a proximal end portion including a clamping device that moves in a direction perpendicular to the primary axis of the arm and the long axis of the axle, and a distal end portion including a tab;

wherein the arms are configured to cooperatively secure a full moment collar flange assembly on the end of an I-beam.

C1. The clamping tool of C, wherein each arm has a platform surface extending from the proximal end portion to the distal end portion, and an inner surface extending orthogonally from the platform surface, the inner surface contacting a web of an I-beam to which a flange assembly is secured.

C2. The clamping tool of C or C1, wherein each clamping device includes a cap nut on a threaded shaft extending through a threaded aperture of the corresponding arm, the cap nut contacting a web of an I-beam to which a flange assembly is secured.

C3. The clamping tool of any of C-C2, wherein the tab of each arm extends along a beam-facing side of a secured flange assembly.

C4. The clamping tool of any of C-C3, wherein the distal end of each arm extends under a main body portion of a flange member of a secured flange assembly.

C5. The clamping tool of any of C-C4, wherein the axle extends along an outer side of a flange of an I-beam to which a flange assembly is secured.

D. A method of securing a collar flange assembly to an I-beam, comprising:

positioning a full moment collar flange assembly at an end of an I-beam;

separating a pair of arms of a clamping tool, along an axle;

positioning the arms on opposing sides of a web of the I-beam;

contacting the arms with the opposing sides of the web;

tightening a clamping device of each arm against a flange of the I-beam.

D1. The method of D, wherein tightening each clamping device includes threading a threaded shaft through an aperture in the corresponding arm, bringing a cap nut on an end of the threaded shaft into contact with an inner side of the flange of the I-beam.

D2. The method of D or D1, further including positioning a distal end of each arm under a first flange member of the collar flange assembly.

D3. The method of D2, further including contacting a tab on the distal end of each arm with a column-facing side of the first flange member.

D4. The method of D2 or D3, further including position a distal end of each arm of a second clamping tool over a second flange member of the collar flange assembly, the second clamping tool having an inverted orientation.

Advantages, Features, and Benefits

The different examples of the clamping tool described herein provide several advantages over known solutions for temporarily fixing a collar flange assembly to the end of an I-beam. For example, illustrative examples described herein allow secure connection without the use of other tools or fasteners.

Additionally, and among other benefits, illustrative examples described herein allow manipulation and/or transportation of a beam with one or more attached collar flange assemblies.

Additionally, and among other benefits, illustrative examples described herein are lightweight and can be manufactured from inexpensive materials.

Additionally, and among other benefits, illustrative examples described herein are adjustable to a variety of both beam and collar flange sizes.

Additionally, and among other benefits, illustrative examples described herein improve safety for workers handling heavy components.

No known system or device can perform these functions, particularly for the specific geometry of a collar flange assembly. Thus, the illustrative examples described herein are particularly useful for manufacture of full moment collar connections. However, not all examples described herein provide the same advantages or the same degree of advantage.

Conclusion

The disclosure set forth above may encompass multiple distinct examples with independent utility. Although each of these has been disclosed in its preferred form(s), the specific examples thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A clamping tool, comprising:

an axle having a long axis; and a pair of arms mounted on the axle, each arm being slideable along the long axis and pivotable relative to the axle, each arm including:

a primary axis perpendicular to the long axis of the axle, a proximal end portion including a clamping device including a threaded shaft that moves in a vertical direction, perpendicular to the primary axis of the arm and the long axis of the axle, and a distal end portion including a fixed vertical tab, extending upwardly.

2. The clamping tool of claim 1, wherein each arm has a platform surface extending from the proximal end portion to the distal end portion, and an inner surface extending orthogonally from the platform surface.

3. The clamping tool of claim 1, whereinthe threaded shaft of each clamping device extends through a threaded aperture of the corresponding arm.

4. The clamping tool of claim 1, wherein each threaded shaft includes a cap nut at a first end.

5. The clamping tool of claim 1, wherein the axle has an adjustable length.

6. The clamping tool of claim 1, wherein the axle includes a telescoping mechanism.

7. The clamping tool of claim 1, wherein each arm includes an assembly of metal sheet pieces.

8. The clamping tool of claim 1, wherein each arm has a width that tapers to a smaller dimension toward the distal end portion.

9. An assembly of a clamping tool securing a full moment collar flange assembly on an end of an I-beam, the clamping tool comprising:

an axle having a long axis; and a pair of arms mounted on the axle and positioned on opposing sides of a web of the I-beam, at least one of the arms being slideable along the long axis, each arm including:

a primary axis perpendicular to the long axis of the axle, a proximal end portion including a clamping device with a threaded shaft that moves in a direction perpendicular to the primary axis of the arm and the long axis of the axle to contact an inner side of an upper flange of the I-beam, and a distal end portion including a tab contacting a front surface of the secured flange assembly;

wherein each clamping device includes a cap nut on the threaded shaft which extends through a threaded aperture of the corresponding arm, the cap nut contacting the web of the I-beam.

10. The assembly of claim 9, wherein each arm has a platform surface extending from the proximal end portion to the distal end portion, and an inner surface extending orthogonally from the platform surface, the inner surface contacting the web of the I-beam.

11. The assembly of claim 9, wherein the distal end of each arm extends under a main body portion of a flange member of the secured flange assembly.

12. The assembly of claim 9, wherein the axle extends along an outer side of the upper flange of the I-beam.

13. The assembly of claim 9, further including a second clamping tool securing the full moment collar flange assembly on the end of the I-beam, the second clamping tool having an inverted orientation.

14. A method of securing a collar flange assembly to an I-beam, comprising:

positioning a full moment collar flange assembly at an end of an I-beam;

separating a pair of arms of a clamping tool, along an axle, the arms being mounted on the axle and each arm being slideable along a long axis of the axle and pivotable relative to the axle, each arm including:

a primary axis perpendicular to the long axis of the axle, a proximal end portion including a clamping device with a threaded shaft that moves in a direction perpendicular to the primary axis of the arm and the long axis of the axle, and a distal end portion including a fixed vertical tab, extending upwardly;

positioning the arms on opposing sides of a web of the I-beam;

contacting the arms with the opposing sides of the web;

contacting the tab of the distal end portion of each arm with a front surface of the first flange member; and tightening the clamping device of each arm against a flange of the I-beam, to contact an inner side of the flange of the I-beam.

15. The method of claim 14, wherein tightening each clamping device includes threading the threaded shaft through an aperture in the corresponding arm, bringing a cap nut on an end of the threaded shaft into contact with an inner side of the flange of the I-beam.

16. The method of claim 14, further including positioning a distal end of each arm under a first flange member of the collar flange assembly.

17. The method of claim 16, further including positioning a distal end of each arm of a second clamping tool over a second flange member of the collar flange assembly, the second clamping tool having an inverted orientation.

* * * * *